US007462250B2

(12) United States Patent
Yamasaki et al.

(10) Patent No.: US 7,462,250 B2
(45) Date of Patent: Dec. 9, 2008

(54) HIGH STRENGTH, HIGH TOUGHNESS, HIGH CARBON STEEL WIRE ROD AND METHOD OF PRODUCTION OF SAME

(75) Inventors: Shingo Yamasaki, Kimitsu (JP); Seiki Nishida, Kimitsu (JP); Toshiyuki Kajitani, Kimitsu (JP); Wataru Yamada, Kimitsu (JP); Yoshitaka Nishikawa, Kimitsu (JP); Nariyasu Muroga, Kimitsu (JP); Nobuyuki Komiya, Kimitsu (JP)

(73) Assignee: Nippon Steel Corporation, Tokyo (JP)

( * ) Notice: Subject to any disclaimer, the term of this patent is extended or adjusted under 35 U.S.C. 154(b) by 368 days.

(21) Appl. No.: 10/543,513

(22) PCT Filed: Jan. 27, 2004

(86) PCT No.: PCT/JP2004/000715

§ 371 (c)(1),
(2), (4) Date: Jul. 26, 2005

(87) PCT Pub. No.: WO2004/067789

PCT Pub. Date: Aug. 12, 2004

(65) Prior Publication Data

US 2006/0137776 A1 Jun. 29, 2006

(30) Foreign Application Priority Data

Jan. 27, 2003 (JP) ..... 2003-017640
Jan. 27, 2003 (JP) ..... 2003-017719
Mar. 31, 2003 (JP) ..... 2003-094190

(51) Int. Cl.
*C22C 38/14* (2006.01)
*C22C 38/28* (2006.01)
*C22C 38/50* (2006.01)

(52) U.S. Cl. ..... 148/320; 148/333; 148/336; 420/125

(58) Field of Classification Search ..... 148/320, 148/332–336, 328, 595, 596, 598–600; 420/125, 420/109, 110
See application file for complete search history.

(56) References Cited

U.S. PATENT DOCUMENTS 5,211,772 A * 5/1993 Ashida et al. ..... 148/336
6,277,220 B1 * 8/2001 Hamada et al. ..... 148/595

FOREIGN PATENT DOCUMENTS

EP 1 114 879 7/2001

(Continued)

OTHER PUBLICATIONS

Computer-generated English translation of Japanese patent 2002-321043, Sugano Koji, May 11, 2002.*

(Continued)

*Primary Examiner*—Deborah Yee
(74) *Attorney, Agent, or Firm*—Kenyon & Kenyon LLP

(57) ABSTRACT

The present invention provides a high strength, high toughness steel wire rod useful for a PC steel wire, galvanized steel strands, spring use steel wire, cables for suspension bridges, etc. By hot rolling, then directly patenting or reaustenitizing, then patenting a high carbon steel wire rod of a specific chemical composition of the steel and chemical composition, size, and numerical density of inclusions, piano wire rod or high carbon steel wire rod having a structure of mainly pearlite, having an average value of the proeutectoid cementite area ratio of 5% or less in a center region of less than 20% of the wire rod diameter from the center of the wire rod, having a micromartensite size of the C section of 100 μm or less, having a tensile strength of the 170 kgf/mm$^2$ class or more, and having a drawing ratio at break of 30% or more is obtained.

3 Claims, 4 Drawing Sheets

FOREIGN PATENT DOCUMENTS

| | | | |
|---|---|---|---|
| EP | 1 243 664 | A1 | 9/2002 |
| EP | 1 264 909 | | 12/2002 |
| JP | 7-41900 | | 2/1995 |
| JP | 2000-178685 | | 6/2000 |
| JP | 2001-181788 | | 7/2001 |
| JP | 2002-321043 | | 11/2002 |

OTHER PUBLICATIONS

European Search Report dated Sep. 7, 2007, EP 04 70 5540.
Patent Abstracts Of Japan—JP 06-299286, Oct. 25, 1994.
Patent Abstracts Of Japan—JP 2002-321043, Nov. 5, 2002.
Patent Abstracts Of Japan—JP 2002-129223, May 9, 2002.
Patent Abstracts of Japan—JP 09-287015, Nov. 4, 1997.
"Influence Of The Reduction of Cord Steel On The Nonmetallic Oxide Inclusions", *Steel In Translation*, vol. 32, No. 5, pp. 29-35, 2002, B.V. Linchevskii, et al.

* cited by examiner

HIGH STRENGTH, HIGH TOUGHNESS, HIGH CARBON STEEL WIRE ROD AND METHOD OF PRODUCTION OF SAME

TECHNICAL FIELD

The present invention relates to piano wire rod or high carbon steel wire rod used for PC steel wire, galvanized steel strands, spring use steel wire, cables for suspension bridges, etc. Further, the present invention relates to a method of production for obtaining a bloom or billet with less center segregation or porosity and therefore a good internal quality in the process of casting molten steel.

BACKGROUND ART

In producing high carbon steel wire, the normal practice is to patent and draw a hot rolled wire rod one or more times to finish it to a predetermined wire diameter. This high carbon steel wire has to be ensured a predetermined strength and be ensured a performance sufficient even for the toughness/ductility evaluated by the drawing ratio at break etc.

The fact that for increasing the strength of high carbon steel wire, increasing the amount of C in chemical compositions of the steel is the most economical and effective means has been confirmed. However, if the increase in the amount of C causes the steel material to become a hyper-eutectoid composition, at the time of rolling or patenting, when cooling from the austenite region, proeutectoid cementite tends to precipitate in a network at the austenite grain boundaries. This tendency appears more remarkably when there is center segregation of C at the center of the wire rod. Further, at the high hardenability center segregation part, micromartensite tends to be formed. As a result, the frequency of breakage at the time of wire drawing also becomes high, thereby inviting a drop in productivity or yield and resulting in poor toughness/ductility of the wire after drawing.

Therefore, Japanese Unexamined Patent Publication (Kokai) No. 2002-129223 proposes a method of including in molten steel with solidified primary crystals of γ-Fe 1 to 10 μm inclusions in an amount of 1 to 500/mm$^2$ to obtain a bloom or billet having a fine solidified structure and using this bloom or billet to produce high carbon steel wire. Further, Japanese Unexamined Patent Publication (Kokai) No. 2001-64753 proposes, for the purpose of improving the lubrication performance in a high carbon steel wire rod for large diameter of steel wire, making the oxide-based inclusions containing Zr etc. hard inclusions of 70% or more of $Al_2O_3$ in composition. Further, Japanese Unexamined Patent Publication (Kokai) No. 2003-96544 proposes high carbon steel wire rod in which delamination is suppressed and ductility is improved by adding either or Mg or Zr to cause formation of fine oxides or sulfides and reduce the solid solution C after patenting.

Next, in producing the above-mentioned bloom or billet, molten steel with solute concentrated among the dendrites moves to the center of the bloom or billet due to the solidification contraction or the flow at the end of solidification due to roll bulging etc. resulting in center segregation. Further, due to the solidification contraction, porosity sometimes occurs at the center of the bloom or billet. In high carbon wire rod, C and Mn concentrate at the center segregation part, so proeutectoid cementite is formed at the austenite grain boundaries, micromartensite is produced, breakage is caused at the time of wire drawing, or the toughness after wire drawing becomes poor.

As the method of suppressing this center segregation, in continuous casting of blooms or billets, using electromagnetic stirring to cause the formation of equiaxed crystals is a widespread practice. In the case of solidification of columnar crystals, the center segregation occurs mostly at the bloom or billet center, but by using this method, the center segregation can be distributed among the equiaxed crystal grains. Further, in continuous casting, the method of reducing the bloom or billet by rolls by exactly the amount corresponding to the amount of solidification contraction at a position where the solid phase ratio of the center part becomes 0.3 to 0.7 so as to suppress flow of solidification contraction and prevent center segregation (soft reduction method) is well known.

Among these, electromagnetic stirring is a method of stirring at the further downstream side of the strand than the method of stirring in the mold, but for converting the solidified structure to equiaxed crystals, it is known that electromagnetic stirring in the mold is extremely effective. However, if performing electromagnetic stirring in the mold, the continuous casting powder becomes entrained and causes defects. For example, with high carbon wire rod, this sometimes becomes a cause of breakage at the time of wire drawing. Therefore, there is a limit to raising the thrust of the electromagnetic stirring in the mold. Further, equiaxed crystals obtained by electromagnetic stirring are relatively large equiaxed crystals, so there is the problem that the segregated grains at the center segregation (size of parts where the solute becomes remarkably concentrated near the center of the bloom or billet) do not become sufficiently fine.

On the other hand, with the soft reduction method, if the timing of reduction can be made suitable, an extremely great center segregation suppression effect can be obtained, but if the reduction is too early or too late, reverse V-segregation or V-segregation will occur. In general, there is a variation in the growth of a solidified shell in continuous casting. With just soft reduction, sometimes incomplete formation occurs.

In the above way, sufficient reduction of center segregation in continuous casting is an important technical issue even at the present.

As another method for suppressing such center segregation, there is the method of causing fine inclusions to distribute in molten steel and utilizing these as nuclei for the formation of heterogeneous nuclei at the time of solidification so as to raise the equiaxed crystal zone ratio and make the equiaxed crystals finer.

The above mentioned Japanese Unexamined Patent Publication (Kokai) No. 2002-129223 discloses a bloom or billet provided with a fine solidified structure characterized by including and causing solidification of inclusions with a lattice strain with γ-Fe of 7% or less in molten steel where the solidified primary crystals are γ-Fe. Further, as these inclusions, ones containing one or more of MgS, $ZrO_2$, $Ti_2O_3$, $CeO_2$, or $Ce_2O_3$ may be mentioned.

DISCLOSURE OF THE INVENTION

The present invention was made taking note of the above situation and has as its object to cause provide inclusions with good coherency with γ-Fe in molten steel so as to raise the equiaxed crystal zone ratio at the time of solidification and reduce the center segregation so as to thereby restrict the precipitation of proeutectoid cementite at the center of the wire rod after rolling and thereby provide a high carbon steel wire rod able to prevent breakage at the time of wire drawing. That is, the present inventors discovered that with the technology disclosed in the above-mentioned Japanese Unexamined Patent Publication (Kokai) No. 2002-129223, a fine solidified structure still cannot be obtained and that for this purpose, 10 μm or less fine inclusions are effective and that their numerical density must be 500/mm$^2$ or more.

Further, the present inventors discovered that by employing deoxidizing means for obtain a greater effect of refinement of equiaxed crystals by $ZrO_2$, it is possible to reduce center segregation.

The present invention was made based on the above-mentioned discoveries and has as its gist the following so as to solve the above-mentioned problems:

(1) A high strength and high toughness carbon steel wire rod containing high C content of C in an amount of 0.95 wt % or less, characterized by further containing, Zr in an amount of 10 wt ppm or more and 500 wt ppm or less and by including in said wire rod inclusions having a size of 0.1 to 10 μm, having a mole fraction of Zr of 0.2 or more in the $ZrO_2$ inclusions, and having a numerical density of 500 to 3000/mm$^2$.

(2) A high strength and high toughness carbon steel wire rod as set forth in (1), characterized in that said wire rod has a 90% or more pearlite structure and an average value of the proeutectoid cementite area ratio of 5% or less in a center region of less than 20% of the wire rod radius from the center of said wire rod.

(3) A high strength and high toughness carbon steel wire rod as set forth in (1), characterized in that said wire rod has a 90% or more pearlite structure and a size (maximum length) of the micromartensite grains of 100 μm or less in a center region of less than 20% of the wire rod radius from the center of said wire rod.

(4) A high strength and high toughness carbon steel wire rod as set forth in any of (1) to (3), characterized by being comprised, by wt, of C:0.6 to 0.95%, Si:0.12 to 1.2%, Mn:0.3 to 0.9%, P:0.030% or less, S:0.030% or less, and Zr:10 wt ppm or more and 500 wt ppm or less as basic chemical compositions and further by containing one or more of N:0.003 to 0.015%, Al:0.001 to 0.2%, Ti:0.001 to 0.2%, Cr:0.05 to 1.0%, Ni:0.05 to 1.0%, Co:0.05 to 1.0%, W:0.05 to 1.00, V:0.05 to 0.5%, Nb:0.01 to 0.2%, and Cu:0.2% or less.

(5) A method of production of a high strength and high toughness carbon steel wire rod characterized by deoxidizing molten steel having a steel composition as set forth in any of (1) to (4) by one or more of any of Al, Ti, Si, and Mn, reducing the amount of dissolved oxygen to 10 to 50 wt ppm, then adding Zr to adjust the Zr content in the steel to 10 wt ppm or more and 500 wt ppm or less, next casting the steel to produce a slab, hot rolling it under ordinary conditions, then directly patenting it or heating it again to the temperature of the austenite region, then directly patenting it.

BEST MODE FOR WORKING THE INVENTION

Figure 1:
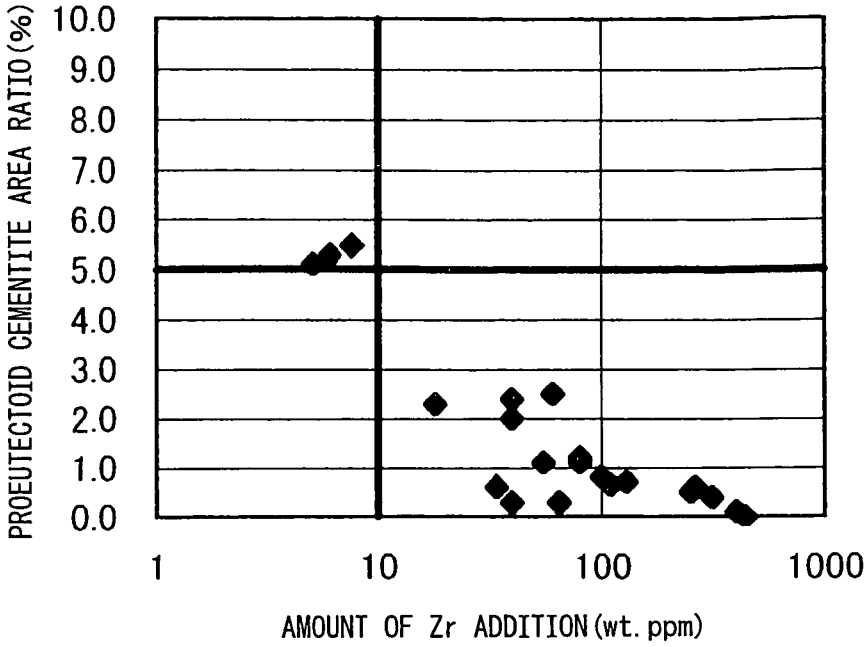
FIG. 1 is a graph showing the relationship between an amount of addition of Zr and a proeutectoid cementite area ratio.

The present invention specifies the chemical compositions of the high carbon steel wire rod, crystal structure, size, and numerical density of the inclusions contained in the wire rod to improve the equiaxed crystal zone ratio at the time of solidification of a bloom or billet and reduce the center segregation and thereby restrict the precipitation of proeutectoid cementite and micromartensite at the center of the wire rod after rolling and thereby provide high carbon steel wire rod able to prevent breakage at the time of wire drawing.

The reasons for setting these requirements will be explained in detail next. First, the reasons for setting the composition of the high carbon steel wire rod were as follows:

C is an element essential as an element strengthening steel materials. If less than 0.6%, at the time of patenting, the amount of proeutectoid ferrite increases, so the required strength cannot be obtained, while if over 0.95%, the amount of proeutectoid cementite increases and the wire drawing characteristics remarkably deteriorate, so C was restricted to a range of 0.6 to 0.95%.

Si is useful as a deoxidizing element and dissolves in ferrite to exhibit a remarkable effect of strengthening the solid solution. In addition, the Si in the ferrite reduces the reduction in strength at the time of the blueing after wire drawing or hot dip zinc coating and further improves the relaxation characteristic in its action. If less than 0.12%, the above action cannot be exhibited, while if over 1.2%, this effect becomes saturated, so Si was limited to the range of 0.12 to 1.2%.

Mn is not only necessary for deoxidation and desulfurization, but also acts to raise the strength of the patenting material, but if less than 0.3%, the above effect cannot be obtained, while if over 0.9%, the segregation at the time of casting becomes serious and micromartensite which degrade the wire drawability is produced at the time of patenting, so Mn was limited to the range of 0.3 to 0.9%.

P co-segregates along with Mn and remarkably raises the hardenability, so promotes the formation of micromartensite at the time of patenting, therefore P was made 0.030% or less.

S precipitates as MnS and degrade the wire drawability, so S was made 0.030% or less.

Zr is an essential element in the present invention. By its addition to the molten steel, $ZrO_2$ inclusions with good coherency with the γ-Fe of the primary crystal structure at the time of solidification are formed, so it is an essential element for the present invention, but if less than 10 wt ppm, a sufficient number of $ZrO_2$ inclusions cannot be obtained, while if 500 wt ppm or more, clusters of coarse $ZrO_2$ are formed causing degradation of the mechanical properties. Therefore, the upper limit was set to 500 wt ppm.

Further, in the present invention, in addition to the above elements, one or two or more of N, Al, Ti, Cr, Ni, Co, W, V, or Nb may be added. Below, the reasons for adding these elements will be explained.

N forms nitrides with Al or Ti in the steel and acts to prevent coarsening of the austenite grain size at the time of heating.

This effect is effectively exhibited by inclusion in an amount of 0.003% or more. However, if the content becomes too great, the Al nitrides increase too much and start to have a detrimental effect on the wire drawability and, further, that solid solution N starts to be promote aging during the wire drawing. Therefore, the upper limit was made 0.015%.

Al is a necessary element effective as a deoxidizing agent or for preventing coarsening of the austenite grain size. However, if excessively included, it forms coarse clusters of $Al_2O_3$ which have a detrimental effect on the wire drawability. Therefore, the upper limit was made 0.2%.

Ti is a necessary element effective as a deoxidizing agent or for preventing coarsening of the austenite grain size. However, if excessively included, it forms large amounts of TiN which have a detrimental effect on the wire drawability. Therefore, the upper limit was made 0.2%.

Cr makes the lamellar distance of the pearlite finer and acts to raise the strength of the wire rod and the wire drawability. These effects are effectively exhibited with 0.05% or more. However, if over 1.0%, the transformation end time becomes too long, thereby inviting an increased size of the facilities and a drop in the productivity. Therefore, 1.0% was made the upper limit.

Ni does not contribute that much to the rise in the wire rod strength, but acts to raise the toughness of the drawn wire rod. This effect is effectively exhibited by including Ni in an amount of 0.05% or more. However, if the amount of Ni becomes excessive, the transformation end time becomes too long, thereby inviting an increased size of the facilities and a drop in the productivity. Therefore, 1.0% was made the upper limit.

Co is effective for suppressing precipitation of proeutectoid cementite. This effect is effectively exhibited by inclusion in an amount of 0.05% or more. However, this effect becomes saturated at about 1.0%, so there is no economic merit in adding more than this.

W also has the action of raising the wire rod strength. This effect is effectively exhibited by inclusion in an amount of 0.05% or more. However, if the content becomes too large, the effect of improvement of the strength becomes saturated and, further, there is a detrimental effect on the toughness/ductility, so W has to be suppressed to 1.0% or less.

V and Nb form fine carbonitrides in the steel and contribute to the improvement of the strength by precipitation hardening and also act to prevent coarsening of the austenite grains at the time of heating. These effects are effectively exhibited by inclusion in amounts of the above lower limits or more. However, if included in amounts over the upper limits, not only does the amount of carbonitrides increase too much, but also the grain size of said carbonitrides becomes larger and the toughness is reduced, so 0.05 to 0.5% and 0.01 to 0.2% were made the ranges of addition.

Cu is an element improving the corrosion fatigue resistance of the wire after drawing, but excessive addition causes a reduction in the heat treatability of the steel and the ductility of the ferrite phase. Therefore, the content was made 0.2% or less.

In the present invention, by using a high carbon steel wire rod satisfying the above-mentioned composition, hot rolling it, then directly patenting it or reaustenitizing it, then patenting it, a steel wire rod is obtained mainly comprised of fine pearlite and, as shown in FIG. 1, having an average value of the proeutectoid cementite area ratio of 5% or less in the center region ($r<0.2d$) having a length (r) from the center (p) of the wire rod of less than 20% of the wire rod radius (d).

That is, as explained above, in a steel material of a hypereutectoid composition with a large amount of C, when cooling from the austenite region in the patenting process, proeutectoid cementite precipitates in a network along the grain boundaries of the austenite. This proeutectoid cementite not only causes a decline in the hardenability of steel and inhibits the improvement of strength, but also has an adverse effect on the wire drawability. However, the inventors ran various studies according to which the factors particularly influencing the wire drawability were found to be the proeutectoid cementite and micromartensite precipitated at the center of said wire rod. Regarding the proeutectoid cementite, as explained above, it was confirmed that with an average value of the area ratio of the proeutectoid cementite in the $r<0.2d$ center region suppressed to 5% or less, even when setting the subsequent wire drawing ratio to a range of 70 to 90%, there is no breakage etc. and the drop in the hardenability is suppressed to the minimum extent. Further, regarding the micromartensite, it was confirmed that with a size (maximum length) of the micromartensite grains at the C section of 100 μm or less, even if the subsequent wire drawing ratio is set to a range of 70 to 90%, there is no breakage etc. and the drop in the hardenability is suppressed to the minimum extent.

As the means for obtaining such a proeutectoid cementite area ratio and micromartensite size, it is possible to deoxidize the molten steel by adding Al, Ti, Si, Mn, etc. to obtain molten steel with free oxygen reduced to 10 to 50 wt ppm, add Zr to this to replace the $Al_2O_3$ with $ZrO_2$, and thereby finely distribute in the molten steel fine inclusions containing Zr able to form nuclei for the precipitation of the primary crystal structure y-Fe at the time of solidification, raise the equiaxed crystal zone ratio of the γ-Fe at the time of solidification, and suppress the segregation of Mn and C at the center part. On the other hand, if adding Zr without deoxidation, the strong deoxidizing element Zr will produce $ZrO_2$ in large amounts which will aggregate and combine to form coarse $ZrO_2$ which end up floating up to the surface of the molten steel, not finely distributed in the molten steel, and seriously reduce the yield of the Zr.

Next, the inventors ran various experiments on technology for increasing the fineness of equiaxed crystals by $ZrO_2$ in high carbon steel where γ-Fe becomes the primary crystals. As a result, they discovered that in order for $ZrO_2$ to make the equiaxed crystals finer, not adding Al before that or not over adding it is very important. That is, if adding Zr in Al deoxidized steel, the equiaxed crystals become finer to a certain extent. However, if adding Zr to molten steel suppressed in deoxidation by Al and deoxidized by Si—Mn or deoxidized by Si—Ti, a more remarkable effect of refinement of the equiaxed crystals is obtained, it was learned.

Even if adding Zr to the Al deoxidized steel in this way, the equiaxed crystals have difficulty becoming finer since if deoxidizing by Al, a powerful deoxidation action, the dissolved oxygen in the molten steel falls. Even if deoxidizing by Zr after this, the amount of $ZrO_2$ produced becomes smaller. Further, the $Al_2O_3$ clusters formed by the Al deoxidation are further reduced by the Zr with the strong deoxidizing ability and consumed as clusters with part of the added Zr comprised of $ZrO_2$. Due to these reasons, in Al deoxidized steel, the amount of production of fine inclusions of $ZrO_2$ is small and the effect of refinement of the equiaxed crystals is relatively small.

On the other hand, even with similar high carbon steel, if deoxidizing by Si and Mn before deoxidizing by Zr to form MnO—$SiO_2$-based inclusions with high dissolved oxygen and resistance to clustering, the deoxidation by the Zr caused the distribution of micron order (0.1 μm to 10 μm) $ZrO_2$ inclusions and along with that gave fine equiaxed crystals.

Further, it became clear that if adding a slight amount of Ti to molten steel deoxidized by Si and Mn, then deoxidizing it by Zr, the equiaxed crystals become finer. The reason is not clear, but it may be that not only the $ZrO_2$ inclusions, but also the $Ti_2O_3$ act as nuclei causing nonuniformity of equiaxed crystals.

Further, when adding Zr to steel containing Al in an amount of 0.01% or less, then again adding Al, compared with adding Zr to steel containing Al in an amount of 0.01% to 0.04% in advance, the equiaxed crystals become finer. This is believed to be because the $ZrO_2$ does not form clusters.

The high carbon steel is melted in a converter, added with Si and Mn and, in some cases, added with Ti or Al, then poured into a ladle and added with Zr in the ladle. In the addition, it is sufficient to charge grains of metal Zr from above onto the surface of the molten steel not covered by the slag. Further, addition by Zr wire is also possible.

This molten steel is passed through a tundish and, since high carbon steel generally becomes wire rod, rails, or other steel shapes, is cast by a billet or bloom continuous casting machine. In the continuous casting machine, electromagnetic stirring in the mold or strand is also possible. Further, if both adding Zr and, at the end of the solidification process, applying rolling reduction by the soft reduction method, center segregation and porosity can be further improved. Further, casting by the ingot casting method is also possible. After casting, the steel is rolled in the same way as producing normal products.

The concentration of Zr is defined in the following way. That is, to form fine equiaxed crystals, it is necessary to add Zr in an amount of 10 wt ppm or more, preferably 20 wt ppm or more. This lower limit is extremely small, but the solubility product of Zr and oxygen is extremely small and with this extent of addition, a certain degree of an inoculation effect is obtained. The upper limit was made 500 wt ppm, but even if adding more than this, the equiaxed crystals become finer. There is no need to add more of the extremely expensive Zr than this, but even if adding more than this, the $ZrO_2$ will easily cluster and will not effectively act. Note that this concentration of Zr is the value of analysis at the tundish or slab. The same is true for other elements besides Al.

Next, when deoxidizing by Al, the concentration of the Al is defined as follows. That is, to ensure that the $ZrO_2$ finely distributes by leaving dissolved oxygen after the deoxidation by Al and preventing the formation of $Al_2O_3$ clusters, it is preferable that the amount of addition of the Al before addition of the Zr shall be 0.01% or less. Further, when adding Al after adding Zr, the value of analysis at the tundish or slab was made 0.04% or less.

Further, Ti may be added or not added, but by adding 0.003% or more, the equiaxed crystals at the time of adding Zr can be further made to increase. If adding in an amount of 0.02% or more, the oxides of the Ti cluster, so the amount has to be less than that.

Next, a method of verifying the effects of the present invention at a bloom or billet will be explained.

After casting, the solidified structure is observed by the etch print method at the cross-section passing through the center of the bloom or billet and the grain size of the equiaxed crystals and the equiaxed crystal zone ratio are measured. The grain size of the equiaxed crystals was measured in the equiaxed crystal zone considering that the locations where the directions of the dendrites change discontinuously represent the boundaries between grains. Further, using the etch print, the segregated grain size at the center segregation (size of parts where solute remarkably concentrates near center of bloom or billet) was also measured.

Further, the number of inclusions in the bloom or billet was measured by an optical microscope and the inclusions were identified by SEM and EDX. In particular, considering that the inclusions forming inoculation nuclei are larger size than that of the micron order, since the number of micron order inclusions among them is far larger than the number of large inclusions, the micron order (0.1 to 10 μm) inclusions were measured above.

Figure 7:
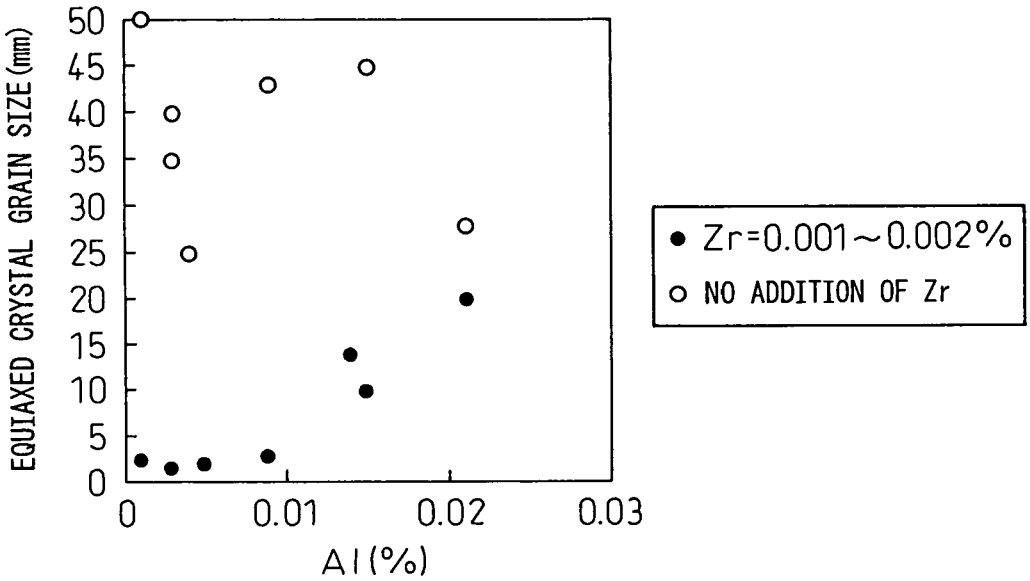
FIG. 7 is a graph showing the effects of the addition of Zr and the amount of addition of Al on the grain size of equiaxed crystals.
Figure 8:
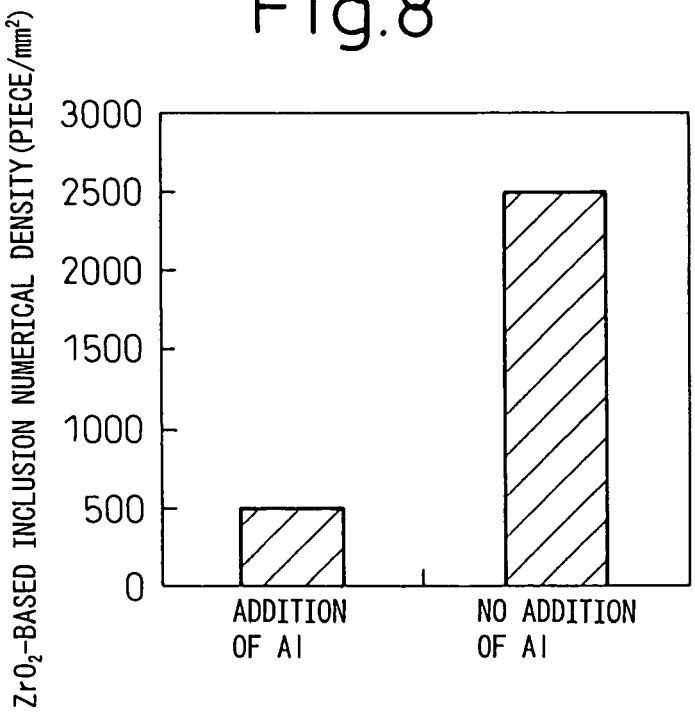
FIG. 8 is a graph showing the number of 0.1 to 10 μm $ZrO_2$ inclusions in the cases of addition of Al (0.02%) and nonaddition of Al.

The grain sizes of the equiaxed crystals when adding to molten steel containing C:0.80%, Si:0.20%, Mn:0.70%, P:0.010%, S:0.01% Al in an amount of 0.003 to 0.03%, then adding Zr in amounts of 0 wt ppm and 20 wt ppm are shown in FIG. 7. It is learned that along with an increase in the Al concentration, the grain size of the equiaxed crystals becomes larger. The results of measurement of the number of inclusions at this time are shown in FIG. 8. It is learned that compared with the addition of Al+Zr, when not adding Al and adding Zr, the number of inclusions becomes larger. Therefore, in the latter case, the equiaxed crystals are believed to become finer.

Note that for the inclusions to function as nuclei for the precipitation of γ-Fe, Zr has to be contained in a mole fraction of 0.2 or more.

Figure 2:
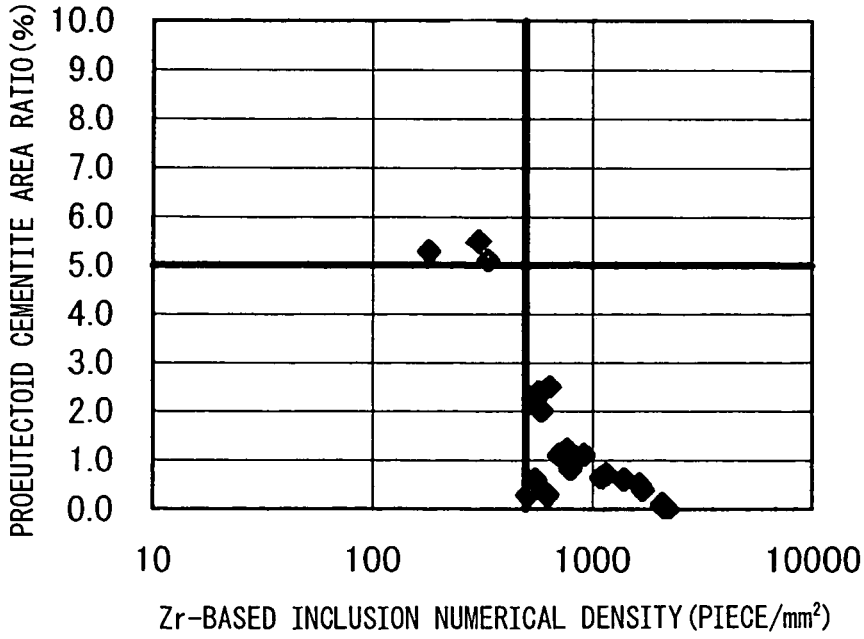
FIG. 2 is a graph showing the relationship between a numerical density of 0.1 to 10 μm Zr-containing inclusions and a proeutectoid cementite area ratio.
Figure 3:
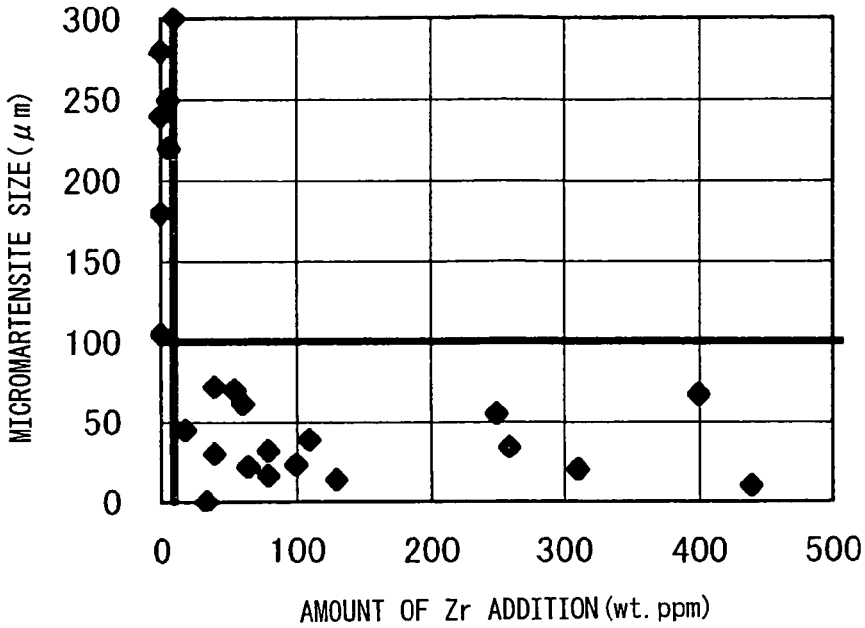
FIG. 3 is a graph showing the relationship between an amount of addition of Zr and a micromartensite size.
Figure 4:
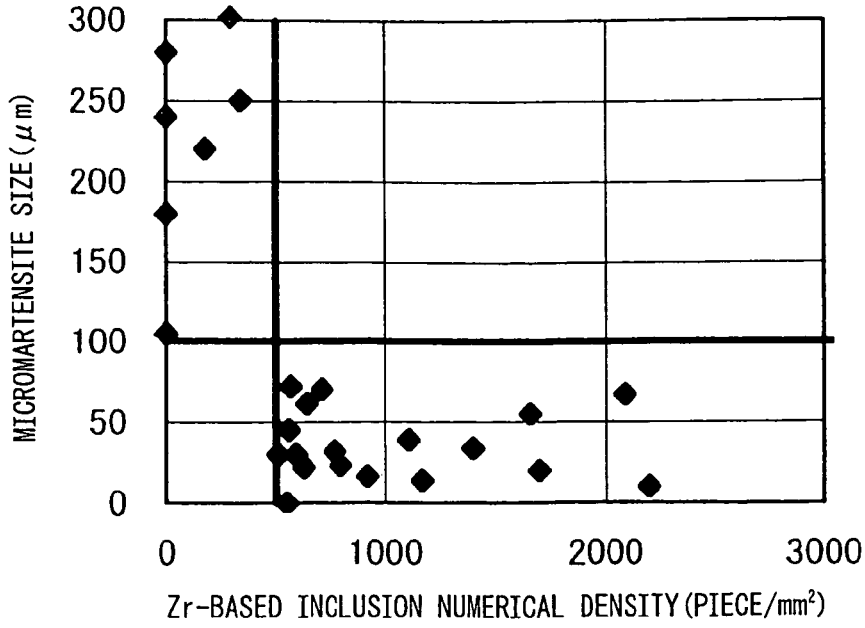
FIG. 4 is a graph showing the relationship between a numerical density of 0.1 to 10 μm Zr-containing inclusions and a micromartensite size.
Figure 5:
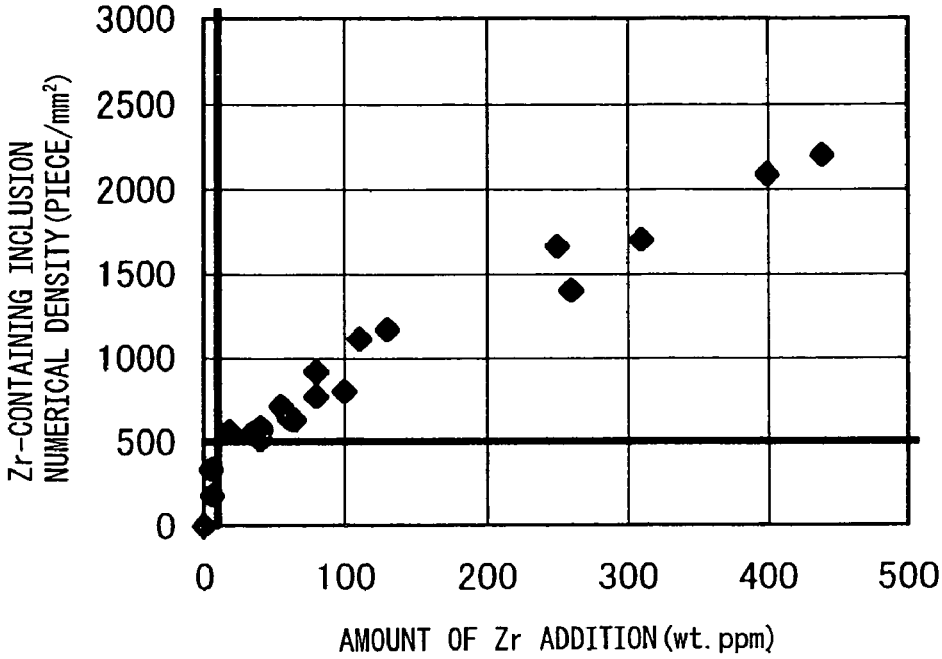
FIG. 5 is a graph showing the relationship between an amount of Zr addition and a numerical density of 0.1 to 10 μm Zr-containing inclusions.
Figure 6:
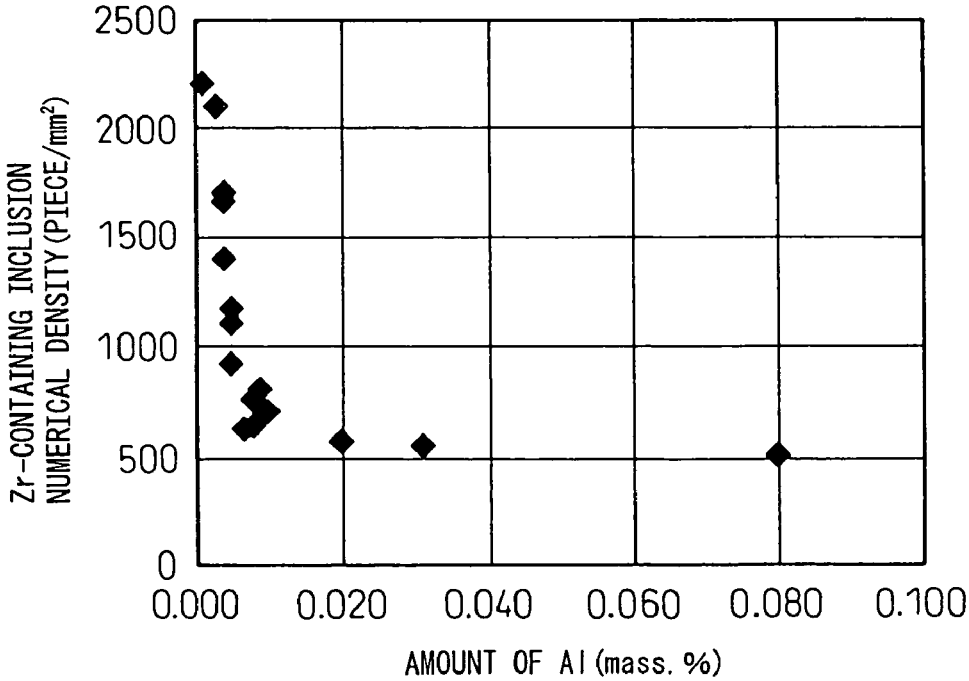
FIG. 6 is a graph showing the effects of the amount of Al on the numerical density of predetermined sizes of Zr-based inclusions.

Further, regarding the conditions defined in the present invention, FIG. 2 shows the relationship between the numerical density of 0.1 to 10 μm Zr-containing inclusions and the proeutectoid cementite area ratio, FIG. 3 shows the relationship of the amount of addition of Zr and the micromartensite size, FIG. 4 shows the relationship of the numerical density of 0.1 to 10 μm Zr-containing inclusions and the micromartensite size, and FIG. 5 shows the relationship between the amount of Zr addition and the numerical density of 0.1 to 10 μm Zr-containing inclusions. Further, FIG. 6 shows the effects of the amount of Al on the numerical density of predetermined sizes of Zr-based inclusions.

EXAMPLE 1

Next, examples will be given to explain the present invention more specifically.

The high carbon steel wire rod of each of the chemical compositions shown in Table 1 was hot rolled after continuous casting to obtain steel wire rod of a diameter of 11 mm, then was directly patented or reheated and then patented under various conditions. (Lead patenting conditions: reheating at 950° C.×5 min->isothermal transformation 540° C×4 min).

This patenting material was polished by embedded abrasives and chemically corroded by dodecyl sulfonic acid. It was then observed under an SEM to determine the proeutectoid cementite area ratio in the center region (r<0.2d) of a length (r) from the center (p) of less than 20% of the wire rod radius (d). Further, the material was polished by embedded abrasives and chemically corroded using a Nytal solution and then observed under an SEM to determine the size of the micromartensite grains at the C section. Further, the inventors used TEM observation and XEDS analysis of a carbon replica sample to analyze the numerical density, size distribution, and chemical composition of the inclusions. The chemical compositions of the steel materials used for the evaluation are shown in Table 1. The data on the inclusions of the steel materials, the proeutectoid cementite area ratio at the center parts, and the micromartensite size in the C sections are shown in Table 2. Here, the numerical density of the inclusions was obtained by counting by TEM observation of the extracted carbon replica sample. For the sample preparation conditions, the sample surface was diamond polished, the surface layer was etched 5 to 10 μm by the speed etch method, and the exposed inclusions were extracted by the two-stage carbon replica method. This was observed under a TEM. The number of inclusions per unit area of the carbon film was counted.

TABLE 1

Chemical Compositions of Invention Steels and Comparative Steels

| Steel No. | | | Chemical compositions (wt %) | | | | | | | | | | | | | | | |
|---|---|---|---|---|---|---|---|---|---|---|---|---|---|---|---|---|---|---|
| | | | C | Si | Mn | P | S | Cu | Zr | N | Al | Ti | Cr | Ni | Co | W | V | Nb |
| A | Inv. steel | SWRS72A | 0.71 | 0.21 | 0.35 | 0.025 | 0.021 | 0.00 | 34 | 33 | 0.031 | 0.005 | — | — | — | — | — | — |
| B | Inv. steel | SWRS72B | 0.73 | 0.28 | 0.76 | 0.022 | 0.019 | 0.10 | 65 | 40 | 0.007 | 0.008 | — | — | — | — | — | — |
| C | Inv. steel | SWRS75A | 0.76 | 0.12 | 0.31 | 0.008 | 0.007 | 0.00 | 440 | 35 | 0.001 | 0.01 | 0.35 | — | — | — | — | — |
| D | Inv. steel | SWRS75B | 0.74 | 0.14 | 0.63 | 0.011 | 0.010 | 0.00 | 260 | 55 | 0.004 | — | — | 0.50 | — | — | — | — |
| E | Inv. steel | SWRS77A | 0.77 | 0.15 | 0.32 | 0.010 | 0.001 | 0.09 | 130 | 47 | 0.005 | 0.006 | — | — | — | — | — | — |
| F | Inv. steel | SWRS77B | 0.79 | 0.18 | 0.80 | 0.008 | 0.017 | 0.00 | 110 | 50 | 0.005 | 0.007 | — | — | — | — | — | — |
| G | Inv. steel | SWRS80A | 0.82 | 0.36 | 0.48 | 0.015 | 0.013 | 0.00 | 80 | 55 | 0.005 | 0.005 | — | 0.50 | — | — | — | — |
| H | Inv. steel | SWRS80B | 0.85 | 0.82 | 0.68 | 0.021 | 0.007 | 0.10 | 18 | 40 | 0.020 | 0.006 | — | — | — | — | 0.20 | — |
| I | Inv. steel | SWRS82A | 0.83 | 0.30 | 0.45 | 0.012 | 0.013 | 0.00 | 310 | 38 | 0.004 | — | — | 0.30 | — | — | 0.15 | — |
| J | Inv. steel | SWRS82B | 0.85 | 0.28 | 0.68 | 0.021 | 0.007 | 0.10 | 250 | 30 | 0.004 | — | — | — | 0.49 | — | — | — |
| K | Inv. steel | SWRS92A | 0.93 | 0.15 | 0.48 | 0.009 | 0.008 | 0.00 | 100 | 37 | 0.009 | 0.034 | 0.90 | — | — | — | — | — |
| L | Inv. steel | SWRS92B | 0.94 | 0.21 | 0.87 | 0.007 | 0.013 | 0.00 | 61 | 41 | 0.008 | 0.045 | — | — | — | — | — | — |
| M | Inv. steel | SWRH72A | 0.74 | 1.01 | 0.36 | 0.027 | 0.028 | 0.00 | 40 | 45 | 0.080 | 0.033 | — | — | — | — | — | — |
| N | Inv. steel | SWRH72B | 0.73 | 0.33 | 0.72 | 0.020 | 0.026 | 0.00 | 400 | 40 | 0.003 | — | 0.30 | — | — | — | — | — |
| O | Inv. steel | SWRH77A | 0.79 | 0.21 | 0.41 | 0.022 | 0.007 | 0.23 | 80 | 49 | 0.008 | — | — | — | — | 0.56 | — | — |
| P | Inv. steel | SWRH77B | 0.77 | 0.31 | 0.82 | 0.021 | 0.018 | 0.00 | 55 | 39 | 0.010 | — | — | — | — | — | — | 0.10 |
| Q | Inv. steel | SWRH82A | 0.84 | 0.30 | 0.32 | 0.020 | 0.010 | 0.00 | 40 | 50 | 0.020 | — | — | — | — | — | — | — |
| R | Inv. steel | SWRH82B | 0.85 | 0.33 | 0.76 | 0.009 | 0.015 | 0.00 | 40 | 37 | 0.020 | — | — | — | — | — | — | — |
| S | Comp. steel | SWRS72A | 0.71 | 0.21 | 0.35 | 0.025 | 0.021 | 0.00 | 0 | 56 | 0.001 | 0.034 | — | — | — | — | — | — |
| T | Comp. steel | SWRS75B | 0.74 | 0.14 | 0.63 | 0.011 | 0.010 | 0.00 | 0 | 34 | 0.028 | — | — | — | — | — | — | — |
| U | Comp. steel | SWRS80A | 0.82 | 0.36 | 0.48 | 0.015 | 0.013 | 0.00 | 6 | 34 | 0.027 | — | — | — | — | — | — | — |
| V | Comp. steel | SWRS82B | 0.85 | 0.28 | 0.68 | 0.021 | 0.007 | 0.10 | 0 | 38 | 0.036 | — | — | — | — | — | — | — |
| W | Comp. steel | SWRS92B | 0.94 | 0.21 | 0.87 | 0.007 | 0.013 | 0.00 | 5 | 40 | 0.037 | — | — | — | — | — | — | — |
| X | Comp. steel | SWRS72A | 0.73 | 0.35 | 0.39 | 0.025 | 0.026 | 0.00 | 8 | 43 | 0.036 | — | 0.30 | — | — | — | — | — |
| Y | Comp. steel | SWRH72A | 0.74 | 0.34 | 0.36 | 0.027 | 0.028 | 0.00 | 0 | 41 | 0.033 | — | 0.30 | — | — | — | — | — |
| | | | | | | | | | (wt ppm) | (wt ppm) | | | | | | | | |

TABLE 2

Properties of Inclusions and Proeutectoid Cementite
Area ratios of Invention Steels and Comparative Steels

| Steel No. | | | Wire rod dia. | Zr-containing inclusions numerical density (/mm$^2$) | Mole fraction of Zr in inclusions | Proeutectoid cementite area ratio/% | Micromartensite size/μm |
|---|---|---|---|---|---|---|---|
| A | Inv. steel | SWRS72A | 11 | 550 | 0.55 | 0.6 | 0 |
| B | Inv. steel | SWRS72B | 13 | 630 | 0.69 | 0.3 | 22 |
| C | Inv. steel | SWRS75A | 11 | 2200 | 0.8 | 0.0 | 10 |
| D | Inv. steel | SWRS75B | 11 | 1400 | 0.34 | 0.6 | 34 |
| E | Inv. steel | SWRS77A | 11 | 1170 | 0.66 | 0.7 | 14 |
| F | Inv. steel | SWRS77B | 12 | 1110 | 0.45 | 0.7 | 39 |
| G | Inv. steel | SWRS80A | 11 | 920 | 0.91 | 1.1 | 16 |
| H | Inv. steel | SWRS80B | 11 | 560 | 0.67 | 2.3 | 45 |
| I | Inv. steel | SWRS82A | 11 | 1700 | 0.87 | 0.4 | 20 |
| J | Inv. steel | SWRS82B | 11 | 1660 | 0.54 | 0.5 | 55 |
| K | Inv. steel | SWRS92A | 13 | 800 | 0.66 | 0.8 | 23 |
| L | Inv. steel | SWRS92B | 11 | 640 | 0.81 | 2.5 | 61 |
| M | Inv. steel | SWRH72A | 11 | 510 | 0.43 | 0.3 | 30 |
| N | Inv. steel | SWRH72B | 11 | 2090 | 0.38 | 0.1 | 67 |
| O | Inv. steel | SWRH77A | 11 | 770 | 0.76 | 1.2 | 32 |
| P | Inv. steel | SWRH77B | 12 | 710 | 0.65 | 1.1 | 70 |
| Q | Inv. steel | SWRH82A | 11 | 590 | 0.59 | 2.0 | 30 |
| R | Inv. steel | SWRH82B | 11 | 570 | 0.87 | 2.4 | 72 |
| S | Comp. steel | SWRS72A | 12 | 0 | 0 | 7.8 | 105 |
| T | Comp. steel | SWRS75B | 11 | 0 | 0 | 8.1 | 240 |
| U | Comp. steel | SWRS80A | 12 | 180 | 0.44 | 5.3 | 220 |
| V | Comp. steel | SWRS82B | 11 | 0 | 0 | 5.9 | 180 |
| W | Comp. steel | SWRS92B | 11 | 340 | 0.65 | 5.1 | 250 |
| X | Comp. steel | SWRH72A | 11 | 310 | 0.15 | 5.5 | 300 |
| Y | Comp. steel | SWRH72A | 11 | 0 | 0 | 6.2 | 280 |

In Tables 1 and 2, Invention Steel Nos. 1 to 18 contained Zr in amounts of 10 wt ppm to 100 wt ppm in the steel, so could give high strength, high toughness, high carbon wire rods satisfying all of the conditions of having Zr inclusions with mole fractions of Zr of 0.2 or more and with numerical densities of 500 to 3000/mm$^2$, having average values of the proeutectoid cementite area ratios of 5% or less in the center region of less than 20% of the wire rod radius from the center of the wire rod, and having micromartensite sizes of 100 μm. On the other hand, Comparative Steels U, W, and X contained Zr, but the amounts added were small ones of 10 ppm or less, so the numerical densities of the Zr-containing inclusions were small or the contents of Zr in the inclusions were small, so sufficient equiaxiality could not be obtained and therefore center segregation of the carbon could not be suppressed and as a result the formation of coarse micromartensite or proeutectoid cementite could not be suppressed.

Further, Comparative Steels S, T, V, and Y were steel materials not containing Zr, therefore did not have inclusions containing Zr and could not give sufficient equiaxiality.

EXAMPLE 2

Molten steel containing C:0.80%, Si:0.20%, Mn:0.70%, P:0.010%, and S:0.01% was melted in a converter, added with Ti or Al, then added with Zr in the ladle.

This molten steel was cast by a bloom continuous casting machine. An electromagnetic stirring is performed in the mold. Further, depending on the case, at the end of the solidification, rolling reduction was applied by the light reduction method. The size of the bloom was 300 mm×500 mm. The bloom was cut and evaluated by the above methods for the solidified structure, center segregation, and inclusions. (After casting, the bloom was rolled to a wire rod which was then measured for the area ratio of the proeutectoid cementite.)

In Table 3, Comparative Steel No. 8 shows a bloom obtained without addition of Zr. Almost no equiaxed crystals were formed. Even if formed, the equiaxed crystals were extremely coarse and the aggregate grain size was also large. As opposed to this, in Invention Steel Nos. 19 to 21 each showing Ti deoxidation, then addition of Zr, even without electromagnetic stirring, the equiaxed crystal zone ratio was large and the grain size of the equiaxed crystals was small. The number of the inclusions comprised mostly of $ZrO_2$ was remarkably greater than that of Comparative Steel No. 8. It is believed that these functioned as nuclei-forming sites for the equiaxed crystals. In each case, the segregated grain size also became very small.

In Invention Steel No. 22, the amount of addition of Al was considerably large, so the number of inclusions was somewhat small. Therefore, the equiaxed crystal zone ratio was somewhat small, but even so there was an effect of improvement. As opposed to this, if, like in Comparative Steel No. 9, adding Al over the upper limit of the present invention, the effect of the Zr in increasing the equiaxed crystal zone ratio and reducing the equiaxed crystal grain size is small. Invention Steel No. 23 used both mold electromagnetic stirring and Zr addition, but compared with only Zr addition, the formation of equiaxed crystals was promoted and the segregated grain size became very small. Comparative Steel Nos. 11 and 12 used only mold electromagnetic stirring to obtain equiaxed crystals, but the equiaxed crystal zone ratios were considerably large compared with the present invention steels.

Invention Steel No. 24 shows the case of no electromagnetic stirring or light rolling reduction, but addition of Zr. Even with this, the result was a relatively small segregated grain size. Invention Steel No. 25 shows the case of not adding any Al or Ti at all, but adding Zr. Compared with the case of adding Ti, the equiaxed crystals were somewhat small, but compared with the comparative steels, a clear effect of improvement was obtained. Invention Steel No. 26 had a concentration of Al of 0.03%, but since Zr was added in the state containing Al in an amount of 0.005%, a large number of fine equiaxed crystals was obtained.

TABLE 3

| | Zr (%) | Al (%) | Ti (%) | Electromagnetic stirring in mold | Soft reduction | Isometric crystal rate (%) | Isometric crystal grain size (%) | No. of inclusions/ mm$^2$ | Maximum segregated grain size (mm) |
|---|---|---|---|---|---|---|---|---|---|
| Inv. steel 19 | 0.0010 | 0.004 | 0.005 | None | Yes | 30 | 3.5 | 2100 | 3 |
| Inv. steel 20 | 0.0018 | 0.005 | 0.008 | None | Yes | 40 | 2 | 2400 | 2.5 |
| Inv. steel 21 | 0.0041 | 0.003 | 0.01 | None | Yes | 45 | 1.8 | 3500 | 2.7 |
| Inv. steel 22 | 0.0013 | 0.009 | 0.006 | None | Yes | 25 | 2.8 | 1800 | 4 |
| Inv. steel 23 | 0.0015 | 0.003 | 0.005 | Yes | Yes | 60 | 1.5 | 2400 | 2.1 |
| Inv. steel 24 | 0.0018 | 0.005 | 0.007 | None | None | 43 | 2.1 | 3000 | 4 |
| Inv. steel 25 | 0.0018 | 0.003 | 0.001 | None | Yes | 25 | 2.5 | 1500 | 3.5 |
| Inv. steel 26 | 0.0017 | 0.03 (0.005) | 0.005 | None | Yes | 26 | 2.5 | 1500 | 3.8 |
| Comp. steel 8 | 0.0003 | 0.003 | 0.003 | None | Yes | 1 | 30 | 200 | 10 |
| Comp. steel 9 | 0.0015 | 0.21 | 0.003 | None | Yes | 5 | 20 | 600 | 6 |
| Comp. steel 10 | 0.0001 | 0.003 | 0.001 | None | None | 0 | None | 100 | 16 |
| Comp. steel 11 | 0.0002 | 0.02 | 0.003 | Yes | Yes | 30 | 8 | 50 | 7 |
| Comp. steel 12 | 0.0001 | 0.004 | 0.006 | Yes | None | 34 | 9 | 100 | 11 |

INDUSTRIAL APPLICABILITY

The present invention specifies the chemical compositions of the steel material used and causes inclusions containing Zr and having good coherency with the primary crystals γ to distribute in it so as to improve the equiaxed grain size of the solidified structure and suppress center segregation and thereby obtain a hard steel wire rod or piano wire rod with an average area ratio of the proeutectoid cementite of 5% or less near the center of the rolled wire rod and a micromartensite size in the C-section of 100 μm or less and consequently improve the performance as PC steel wire, galvanized steel wire, spring use steel wire, suspension bridge use cables etc.

The invention claimed is:

1. A high strength and high toughness carbon steel wire rod containing C in an amount of 0.95 wt % or less, characterized by further containing, Zr in an amount of 10 wt ppm or more and 500 wt ppm or less and by including in said wire rod inclusions having a size of 0.1 to 10 μm, having a mole fraction of Zr of 0.2 or more in the $ZrO_2$ inclusions, and having a numerical density of 500 to 3000/mm$^2$ , and said wire rod has a 90% or more pearlite structure and an average value of the proeutectoid cementite area ratio of 5% or less in a center region of less than 20% of the wire rod radius from the center of said wire rod.

2. A high strength and high toughness carbon steel wire rod containing C in an amount of 0.95 wt % or less, characterized by further containing, Zr in an amount of 10 wt ppm or more and 500 wt ppm or less and by including in said wire rod inclusions having a size of 0.1 to 10 μm, having a mole fraction of Zr of 0.2 or more in the $ZrO_2$ inclusions, and having a numerical density of 500 to 3000/mm$^2$ , and said wire rod has a 90% or more pearlite structure and a micromartensite structure having a grain size (maximum length) of 100 μm or less in a center region of less than 20% of the wire rod radius from the center of said wire rod.

3. A high strength and high toughness carbon steel wire rod as set forth in claim 1 or 2, characterized by being comprised, by wt, of C:0.6 to 0.95%, Si:0.12 to 1.2%, Mn:0.3 to 0.9%, P:0.030% or less, S:0.030% or less, and Zr:10 wt ppm or more and 500 wt ppm or less as basic chemical compositions and further by containing one or more of N:0.003 to 0.015%, Al:0.001 to 0.2%, Ti:0.001 to 0.2%, Cr:0.05 to 1.0%, Ni:0.05 to 1.0%, Co:0.05 to 1.0%, W:0.05 to 1.00, V:0.05 to 0.5%, Nb:0.01 to 0.2%, and Cu:0.2% or less.

* * * * *